US008141870B2

(12) United States Patent
Griese et al.

(10) Patent No.: US 8,141,870 B2
(45) Date of Patent: Mar. 27, 2012

(54) METHODS FOR MOVING A MEDIA SHEET WITHIN AN IMAGING DEVICE

(75) Inventors: Paul Edward Griese, Versailles, KY (US); Patrick Lawrence Ransom, Lexington, KY (US); Bonnie Billy Lim Sy, Cebu (PH)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 12/750,318

(22) Filed: Mar. 30, 2010

(65) Prior Publication Data

US 2011/0241292 A1 Oct. 6, 2011

(51) Int. Cl.
*B65H 7/02* (2006.01)

(52) U.S. Cl. ..... 271/227; 271/228; 271/242; 271/246; 271/265.01

(58) Field of Classification Search ..... 271/227, 271/228, 242, 245, 246, 266, 270, 264, 265.01
See application file for complete search history.

(56) References Cited

U.S. PATENT DOCUMENTS

| | | | | |
|---|---|---|---|---|
| 4,455,018 | A * | 6/1984 | Colglazier et al. | 271/227 |
| 5,597,154 | A * | 1/1997 | Yamashita | 271/10.05 |
| 5,738,349 | A * | 4/1998 | Shirasaki | 271/242 |
| 5,775,690 | A * | 7/1998 | Quesnel et al. | 271/242 |
| 5,967,506 | A * | 10/1999 | Miki et al. | 271/10.13 |
| 7,108,368 | B2 * | 9/2006 | Saito et al. | 347/104 |
| 7,871,073 | B2 * | 1/2011 | Noguchi et al. | 271/265.01 |
| 2002/0063384 | A1 * | 5/2002 | Quesnel | 271/270 |
| 2008/0232880 | A1 * | 9/2008 | Noguchi et al. | 399/397 |
| 2010/0019440 | A1 * | 1/2010 | Fujiwara et al. | 271/10.02 |

* cited by examiner

*Primary Examiner* — Kaitlin Joerger
*Assistant Examiner* — Prasad Gokhale
(74) *Attorney, Agent, or Firm* — Justin M. Tromp; John Victor Pezdek

(57) ABSTRACT

A method for moving a media sheet within an imaging device includes moving a media sheet along a media path past a predetermined point $P_P$ on the media path by rotating a roller. After moving the media sheet past the point $P_P$, a processor monitors whether a performance attribute of a component of the imaging device satisfies a predetermined criteria. After the performance attribute of the component of the imaging device satisfies the predetermined criteria, the media sheet is entered into a feed nip in a substantially deskewed alignment.

18 Claims, 9 Drawing Sheets

METHODS FOR MOVING A MEDIA SHEET WITHIN AN IMAGING DEVICE

CROSS REFERENCES TO RELATED APPLICATIONS

This application is related to application Ser. No. 12/750,392 entitled "Methods for Moving a Media Sheet within an Imaging Device" assigned to the same assignee as the present application.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Invention

The present invention relates generally to a printing peripheral, and more specifically to a method for moving a media sheet within an imaging device and entering the media sheet into a feed nip in a substantially deskewed alignment.

2. Description of the Related Art

Conventional printers, scanners, and all-in-one devices utilize a series of rollers to pick a media sheet and move the media sheet along a media path within the device. The media sheet is moved to a feedroll that advances the media sheet into the scanning or image transfer section of the device. A primary cause of paper jams is an incomplete pick resulting from the media sheet not reaching the feedroll. The optimal rotational distance required to move a media sheet from a known point to the feedroll can be difficult to determine due to slipping from mechanical and frictional variations and differing media stiffness.

In order to avoid a paper jam, the device's rollers must push the media sheet the entire distance to the feed roller. If the rollers are stopped too soon, the media sheet will not make it to the feed rollers and a paper jam may result. However, if the rollers run too long unpleasant noise and unnecessary tire and motor wear may occur. Further, if the rollers run too long, in some instances, the media sheet may be pressed against the feed rollers too hard thereby resulting in folds or dents in the paper. Previously, the method to address this situation was to set the distance from a known point, such as the location of a sensor, to the feed rollers for each media type to the longest needed throughout the printer life. This method reduces the probability of a paper jam. However, as previously stated, this may result in unpleasant noise and unnecessary wear. This method also requires the user to select the correct media type and/or the media detection of the device to properly detect the media type.

It is also desirable that the media sheet enter the feed rollers in a substantially deskewed alignment. If the media sheet is skewed as it enters the feedroll, the media sheet will be skewed when it passes through the scanning section or the image transfer section. Consequently, the resulting scan or print will also be skewed.

Given the foregoing, it will be appreciated that a method for moving a media sheet within an imaging device that adaptively determines the optimum rotational distance to the feedroll for various media types is preferable. It is also preferable to adjust to variation between devices and to changes over the life of a device. Further, it is preferable that such method provide for entry of the media sheet into the feedroll in a substantially deskewed alignment.

SUMMARY OF THE INVENTION

According to an exemplary embodiment, a first method for moving a media sheet within an imaging device includes moving the media sheet along a media path by rotating a roller. While the media sheet is moving, a first sensor is activated with the leading edge of the media sheet and then a second sensor is activated with the leading edge of the media sheet. The number of rotations of the roller during a time period $T_{S1,\ S2}$ between activation of the first sensor and activation of the second sensor by the leading edge of the moving media sheet is determined. A measured distance $D_M$ from the first sensor to the second sensor based on the number of rotations of the roller during the time period $T_{S1,\ S2}$ is calculated. An adjusted distance $D_A$ from the second sensor to a feed nip is then calculated by multiplying the measured distance $D_M$ from the first sensor to the second sensor by a constant based on at least one predetermined distance in the media path. Further, embodiments include those wherein the constant is equal to a predetermined reference distance from the second sensor to the feed nip divided by a predetermined reference distance from the first sensor to the second sensor. The constant is stored in a memory within the imaging device and corresponds with a pick mode selected from the group consisting of direct pick, indirect pick, and duplex pick. After activation of the second sensor, the media sheet continues to move along the media path via the roller and the roller is rotated at least the adjusted distance $D_A$. The media sheet then enters into the feed nip in a substantially deskewed alignment and the roller is stopped. After the media sheet is entered into the feed nip, the media sheet is moved into a print zone for printing or into a scan zone for scanning.

Further, according to an exemplary embodiment, a second method for moving a media sheet within an imaging device includes moving a media sheet along a media path by rotating a roller driven by a motor. The leading edge of the media sheet activates a sensor downstream from the roller. After activating the sensor with the media sheet, the roller is rotated at least a predetermined distance $D_P$. After rotating the roller at least a distance $D_P$, the leading edge of the media sheet is past an entrance to a duplex path along the media path. A processor then begins monitoring whether a performance attribute of a component of the imaging device has satisfied a predetermined criteria. The distance $D_P$ corresponds with a specific pick mode and is stored in a memory within the imaging device. After the performance attribute of the component of the imaging device satisfies the predetermined criteria, the media sheet is entered into a feed nip in a substantially deskewed alignment and the roller is stopped.

BRIEF DESCRIPTION OF THE DRAWINGS

The above-mentioned and other features and advantages of the various embodiments of the invention, and the manner of attaining them, will become more apparent and the invention will be better understood by reference to the following description of embodiments of the invention taken in conjunction with the accompanying drawings, wherein:

FIG. 3 is a side view of the media path showing the media sheet advanced on a simplex path;

FIG. 4 is a side view of the media path showing the media sheet advanced on the simplex path through a feed nip into a print zone;

FIG. 5 is a side view of the media path showing the media sheet advanced into a duplex path;

FIG. 6 is a side view of the media path showing the media sheet advanced from the duplex path back into the simplex path;

FIG. 7 is a side view of the media path showing the media sheet advanced back into the print zone for duplex printing;

DETAILED DESCRIPTION

Figure 1:
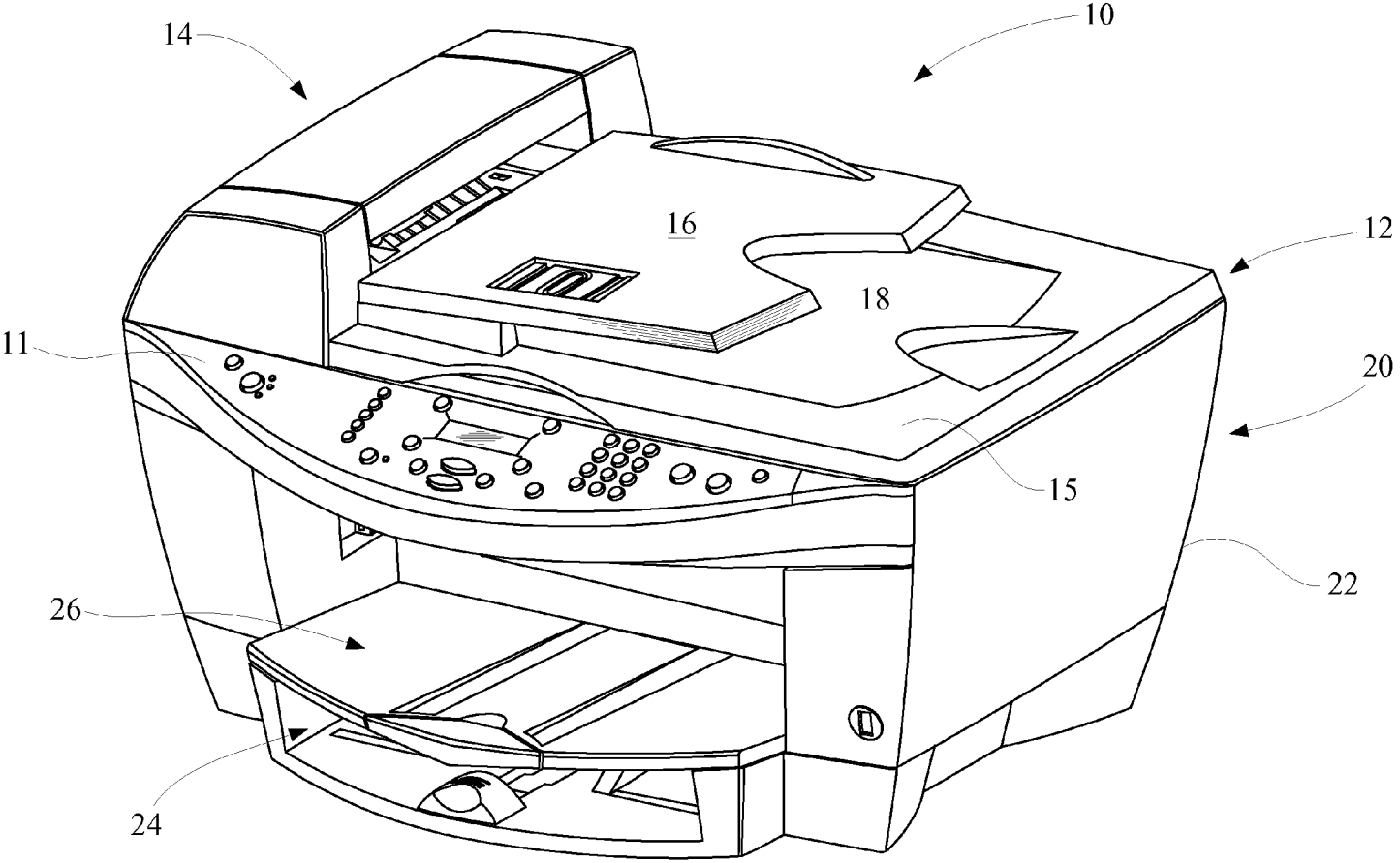
FIG. 1 is a perspective view of an exemplary imaging device.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware.

With reference to FIG. 1, an imaging device 10 is shown having a scanner portion 12 and a printer portion 20 included therewith. The imaging device 10 further comprises a housing 22 wherein the mechanical parts are contained for scanning and printing. The housing 22 is generally box-like in shape but various geometries may be utilized. Within the housing 22 is the printer portion 20 that may be defined by a laser printer, a thermal inkjet printer, a piezo-electric inkjet printer, dye sublimation or other image forming technology. The exemplary embodiment includes an input tray 24 for receiving and supporting a plurality of blank media sheets and an output tray 26 for receiving and supporting the media sheets after the printing process. The imaging device 10 may also comprise a control panel 11 including a plurality of buttons and a display, such as a liquid crystal display (LCD), providing various notifications, menus, and selection options.

The scanner portion 12 generally includes a flat bed scanner, generally indicated beneath a flat-bed scanner lid 15 and an auto-document feed (ADF) scanner 14. The ADF scanner 14 comprises an input tray 16 and output tray 18. The input tray 16 receives and supports one or more stacked documents for feeding one sheet at a time through the ADF scanner 14. The output tray 18 receives and supports the documents following the scanning process and is generally formed on the upper surface of the scanner lid 15. The flat-bed scanner comprises a transparent platen beneath the lid 15 for manual positioning of target media for scanning. The scanner portion 12 is generally disposed on an upper portion of the imaging device 10 above the printer portion 20 although alternate configurations may be utilized. The scanner lid 15 is hingedly attached along the rear edge of the housing 22. The scanner lid 15 may be moved with respect to a scanner bed between a closed position shown in FIG. 1 and an open position (not shown) revealing the transparent platen.

Figure 2:
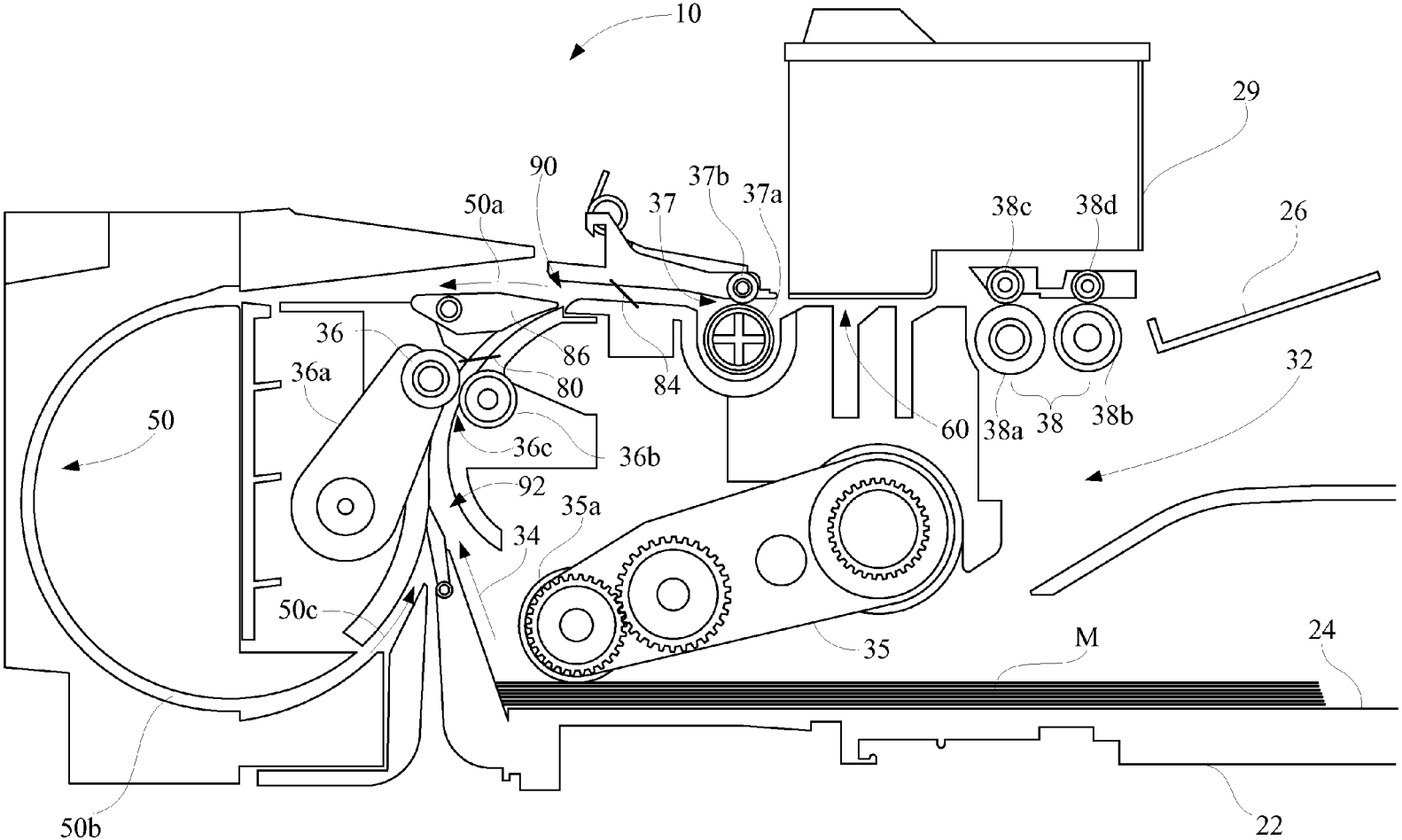
FIG. 2 is a side view of the media path according to an embodiment of the present invention.

With reference to FIG. 2, the imaging device 10 includes a media path 32 which includes a simplex path 34. The imaging device 10 illustrated includes a C-shaped simplex path 34. However, one skilled in the art will understand that the present invention may utilize alternative simplex feed path designs, such as an L-shaped simplex path and that such designs are well within the scope of the present invention. The C-shaped simplex path 34 is shown merely for ease of description. Embodiments include those wherein the media path 32 further comprises a duplex path 50. The media sheets are stored in the input tray 24 in a media stack M. A pick mechanism 35 initiates movement of a media sheet from the media stack M into the simplex path 34. The pick mechanism 35 may comprise an auto-compensating mechanism (ACM) as shown in FIG. 2. The pick mechanism 35 includes a pick roller 35*a* in physical contact with the top most sheet of the media stack. The pick roller 35*a* is driven by a motor (not shown). The rotation of the pick roller 35*a* causes the media to advance upward, one sheet at a time, into the simplex path 34. In some embodiments, the pick roller 35*a* includes sensing means for determining the angular displacement of the pick roller 35*a* such as, for example, an encoder wheel. Embodiments include those wherein sensing means are used to determine the number of rotations of the pick roller 35*a*. Data related to the angular displacement of the pick roller 35*a* is transmitted to a processor (not shown).

Downstream from the pick roller 35*a*, along the simplex path 34, is a roller 36. The roller 36 may comprise an auto-compensating mechanism (ACM) 36*a* as illustrated. The roller 36 is driven by a motor (not shown). The roller 36 may also have a corresponding pressure roller 36*b* such that the motor-driven roller 36 and the pressure roller 36*b* form a nip 36*c*. The ACM 36*a* may be pivotable so as to move the roller 36 and, in turn, open and close the nip 36*c*. Alternatively, the ACM 36*a* may be fixed so that the roller 36 is in an engaged position with the pressure roller 36*b*. The nip 36*c* receives the leading edge of a media sheet moving through the simplex path 34. The roller 36 rotates thereby causing the media sheet to advance through the media path 32 toward a first sensor 80. In some embodiments, the roller 36 includes sensing means for determining the angular displacement of the roller 36 such as, for example, an encoder wheel. Embodiments include those wherein sensing means are used to determine the number of rotations of the roller 36. Data related to the angular displacement of the roller 36 is transmitted to the processor.

As the media sheet passes the first sensor 80, the first sensor 80 is activated. The first sensor 80 then signals the media location to the processor. In some embodiments, the first sensor 80 is activated by the leading edge of the media sheet. The media sheet continues to travel along the media path 32 toward a second sensor 84. As the media sheet passes the second sensor 84, the second sensor 84 is activated. The second sensor 84 then signals the media location to the processor. In some embodiments, the second sensor 84 is activated by the leading edge of the media sheet. In the exemplary embodiment illustrated, the first sensor 80 and the second sensor 84 comprise a mechanical flag sensor. Alternatively, the first sensor 80 and the second sensor 84 may include an optical sensor or any other suitable means for sensing the presence of a media sheet.

Downstream from the first sensor 80 is a gate 86 located generally at a first intersection 90 between the simplex path 34 and the duplex path 50. In the exemplary embodiment illustrated, the gate 86 is upstream from the second sensor 84. Alternatives include those wherein the second sensor 84 is upstream from the gate 86. The gate 86 inhibits the trailing edge of a media sheet from being reversed into the simplex path 34. Alternatively stated, the gate 86 directs media sheets moving from the feed nip 37 toward the duplex path 50.

Downstream from the second sensor 84 is a feed nip 37. In the exemplary embodiment illustrated, the feed nip 37 is formed by a pair of feed rollers 37*a* and 37*b*. The feed rollers 37*a* and 37*b* advance the media sheet through a print zone 60. Alternatives include those wherein the feed nip 37 is formed by a feed roller and a surface. The exemplary feed nip 37 illustrated comprises a reversible feed roll 37*a* and an opposite pressure roll 37*b* wherein the feed rollers 37*a* and 37*b* are capable of moving a media sheet from the simplex path 34 toward the print zone 60 and moving the media sheet away from the print zone 60 into the duplex path 50.

Downstream from the feed nip 37 is the print zone 60. In the embodiment illustrated, the print zone 60 includes a print cartridge 29. The print cartridge 29 selectably ejects ink onto one or both surfaces of the media sheet during simplex or duplex printing, respectively. Alternatives include those wherein an image is transferred to the media sheet by a photoconductive drum as used by a laser printer, by dye sublimation or by any other suitable image forming technology.

Downstream from the print zone 60 along the simplex path 34 is an exit drive system 38 comprising at least one roller. The exemplary embodiment shown includes two driven rollers 38*a* and 38*b* and two pressure rollers 38*c* and 38*d*. The exit drive system 38 receives the media sheet from the feed nip 37 and directs the media sheet to the output tray 26. The output tray 26 resides downstream along the simplex path 34 and receives finished printed media sheets.

In the exemplary embodiment illustrated, adjacent the simplex path 34 is the duplex path 50. Extending from the feed nip 37 toward the duplex path 50 is the first section of the duplex path 50*a*. The first section of the duplex path 50*a* extends from a first intersection 90 between the simplex path 34 and the duplex path 50. The duplex path 50 further comprises a second section 50*b* which is substantially C-shaped. Extending from the second section 50*b* is a third section 50*c* of the duplex path 50. The third section 50*c* feeds back into the simplex path 34 at a second intersection 92 between the simplex path 34 and the duplex path 50.

The exemplary embodiment illustrated in the figures includes one roller 36 disposed on the simplex path 34 between the pick roller 35*a* and the feed nip 37. Alternatives include those wherein additional rollers are disposed on the simplex path 34 such as, for example, two rollers spaced apart on the media path 32 wherein the first roller 36 is upstream from the first sensor 80 and the second roller (not shown) is between the first sensor 80 and the second sensor 84.

Figure 3:
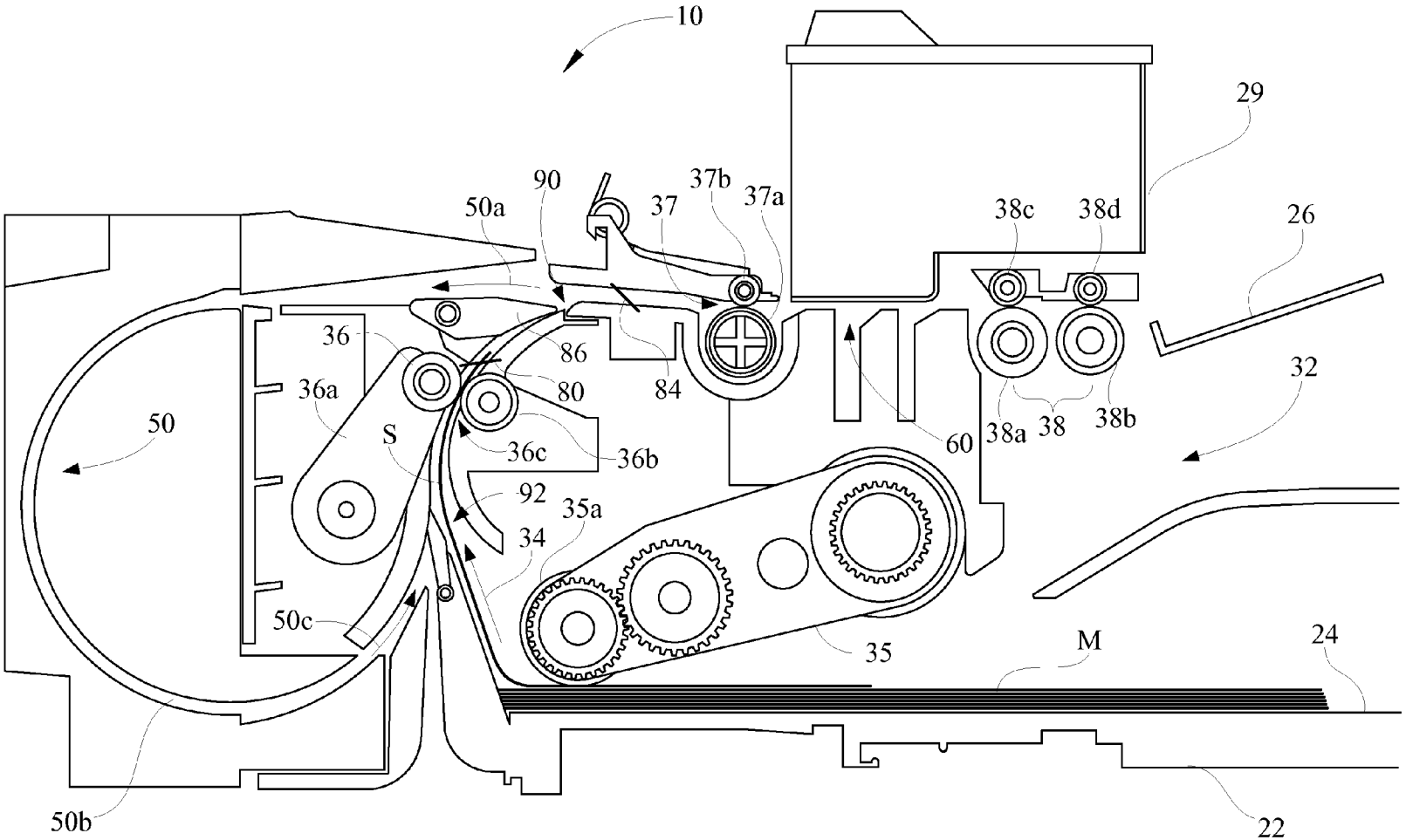
FIGS. 3-7 are sequence views of a media sheet moving on the media path in the imaging device.

FIGS. 3-7 illustrate a sequence of side-views wherein a media sheet S moves through the imaging device 10 during a duplex feeding process. Referring first to FIG. 3, a side view of an exemplary embodiment is depicted. Specifically, the figure depicts a stack of media M within the input tray 24 engaged by the pick roller 35*a*. The pick roller 35*a* has engaged the top most media sheet S of the media stack M and advanced the media sheet S along the simplex path 34. The media sheet S has advanced to the roller 36. The rotation of roller 36 further advances the media sheet S along the simplex path 34. The leading edge of the media sheet S has activated the first sensor 80.

Figure 4:
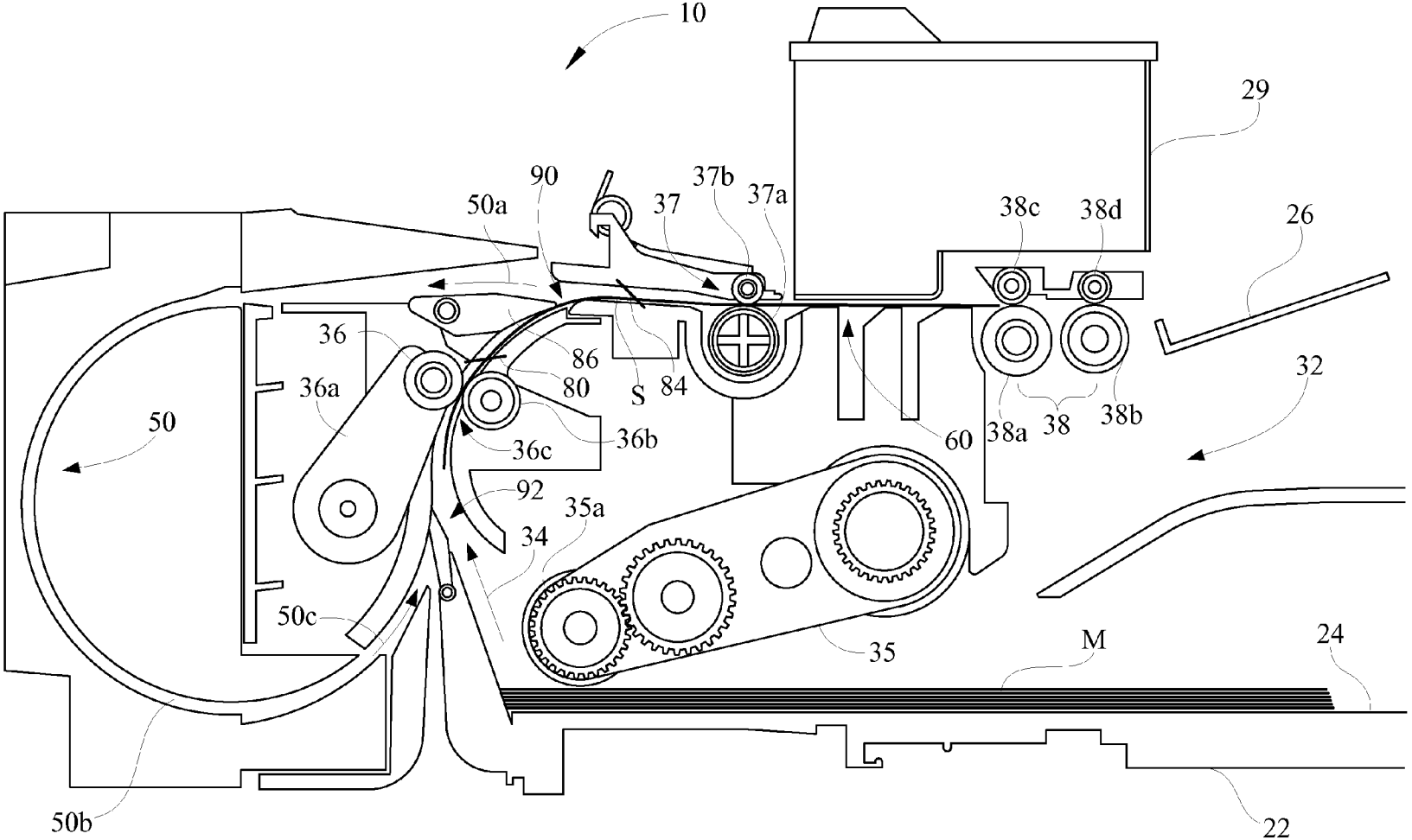

With reference to FIG. 4, the roller 36 continues to move the media sheet S along the simplex path 34. The media sheet S has passed through the gate 86, activated the second sensor 84 and advanced through the feed nip 37 and into the print zone 60. In one embodiment, before the trailing edge of the media sheet S passes through the feed nip 37, in order to accomplish a duplex print, the direction of movement of the media sheet S is reversed. In another embodiment, allowing for printing to the trailing edge of the media sheet S, the direction of movement of the media sheet S is reversed at the exit roller 38.

FIGS. 3 and 4 illustrate an indirect pick where the media sheet S is first moved by the pick roller 35*a* and then by the roller 36 until it reaches the feed nip 37. In some embodiments, the imaging device 10 comprises additional intermediate rollers disposed on the media path 32 between the pick roller 35*a* and the feed nip 37. In these embodiments, an indirect pick is accomplished using a combination of the pick roller 35*a*, the roller 36 and the intermediate rollers. Alternatives include those wherein a direct pick is used where the media sheet S is advanced from the media stack M to the feed nip 37 by the pick roller 35*a*.

Figure 5:
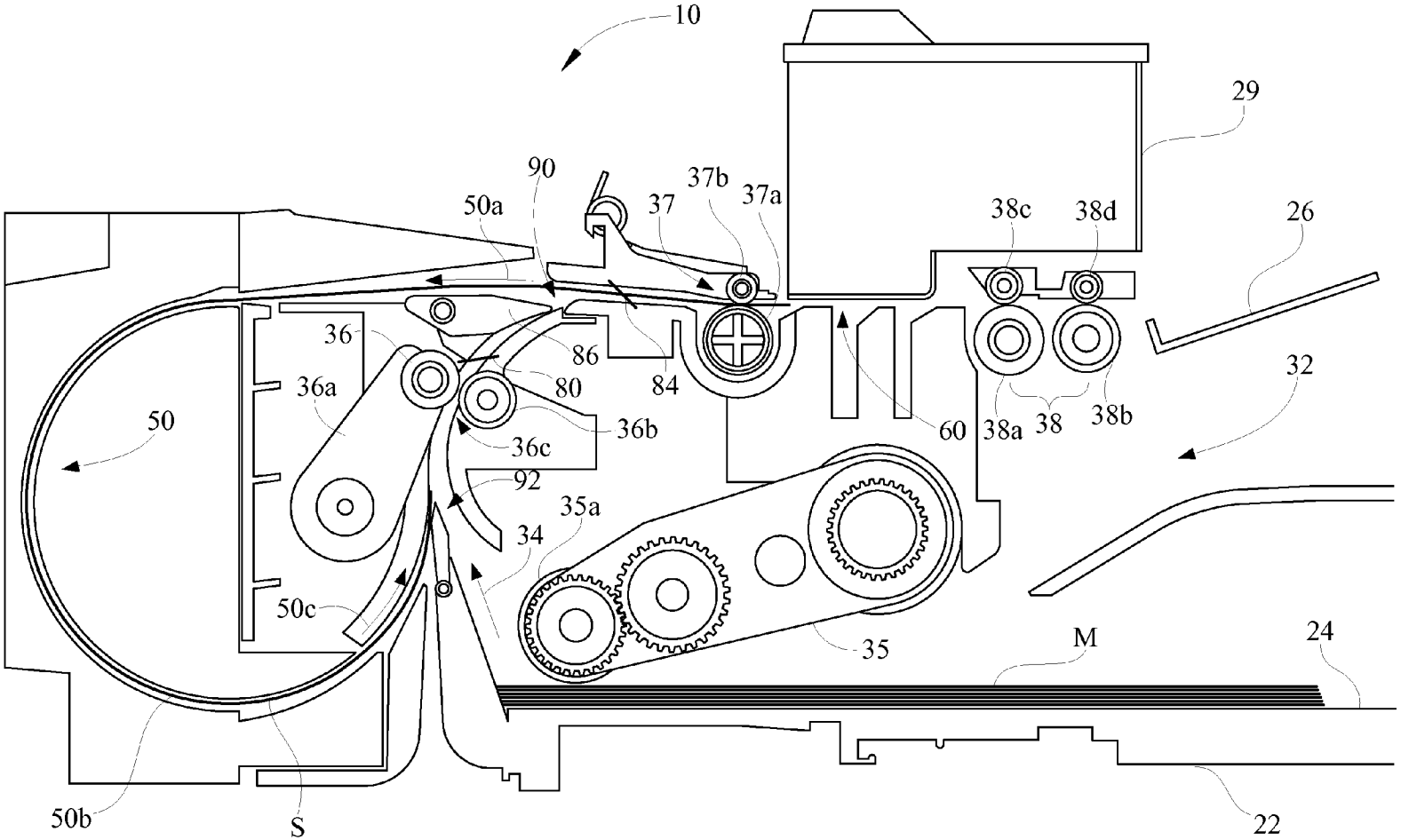

With reference to FIG. 5, the media sheet S is advanced through the duplex path 50 by the feed roller 37*a*. The gate 86 ensures that the media sheet S enters the duplex path 50 and not the simplex path 34. The media sheet S travels around the duplex path 50 and into the nip 36*c* formed by the roller 36 and the corresponding roller 36*b*. In the exemplary embodiment illustrated, the duplex path 50 does not utilize rollers specific to the duplex path 50. Rather, the duplex path 50 merely guides the media sheet S as it is driven by the feed nip 37 and the roller 36. Alternatives include those wherein the duplex path 50 includes a roller disposed on the duplex path 50 for advancing the media sheet S through the duplex path 50.

Figure 6:
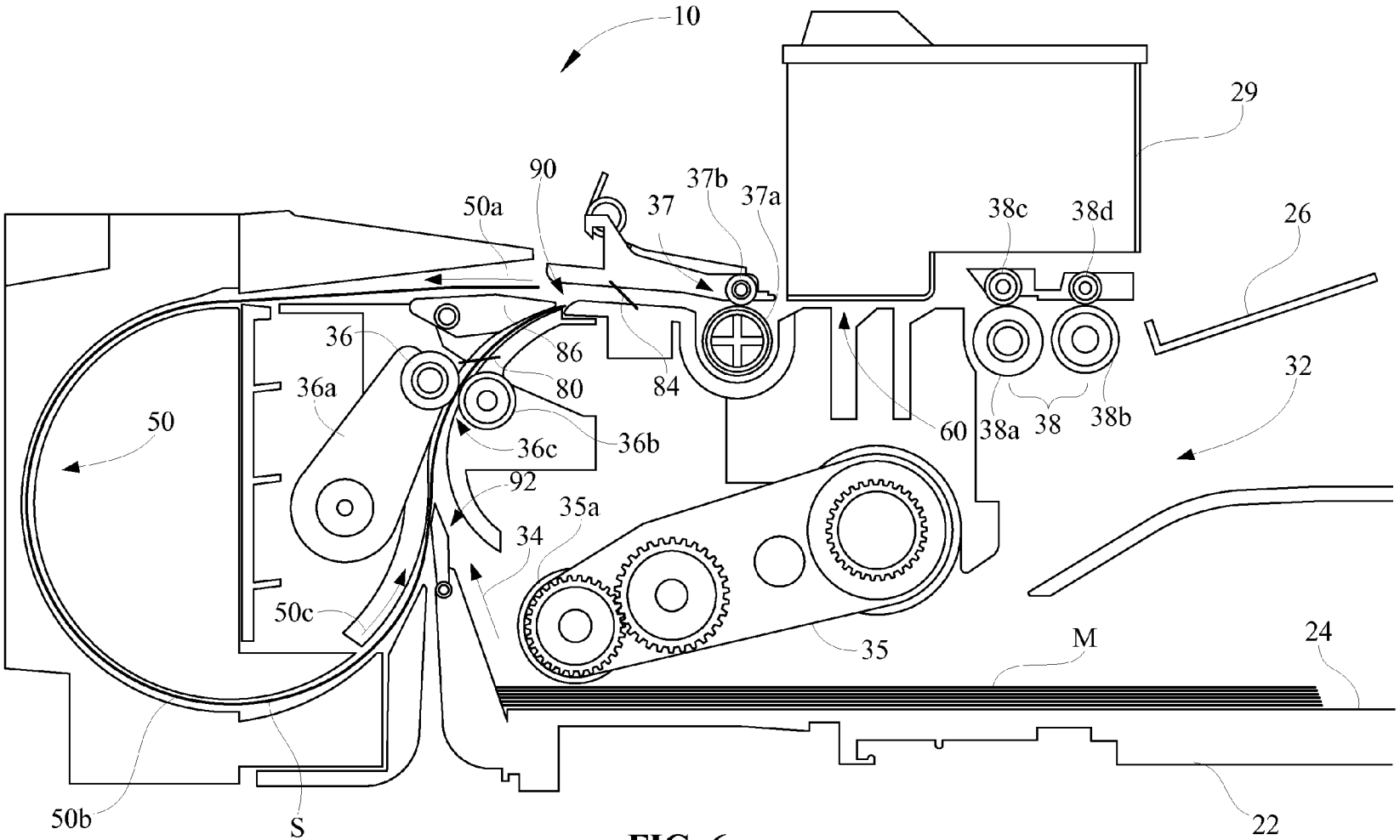
Figure 7:
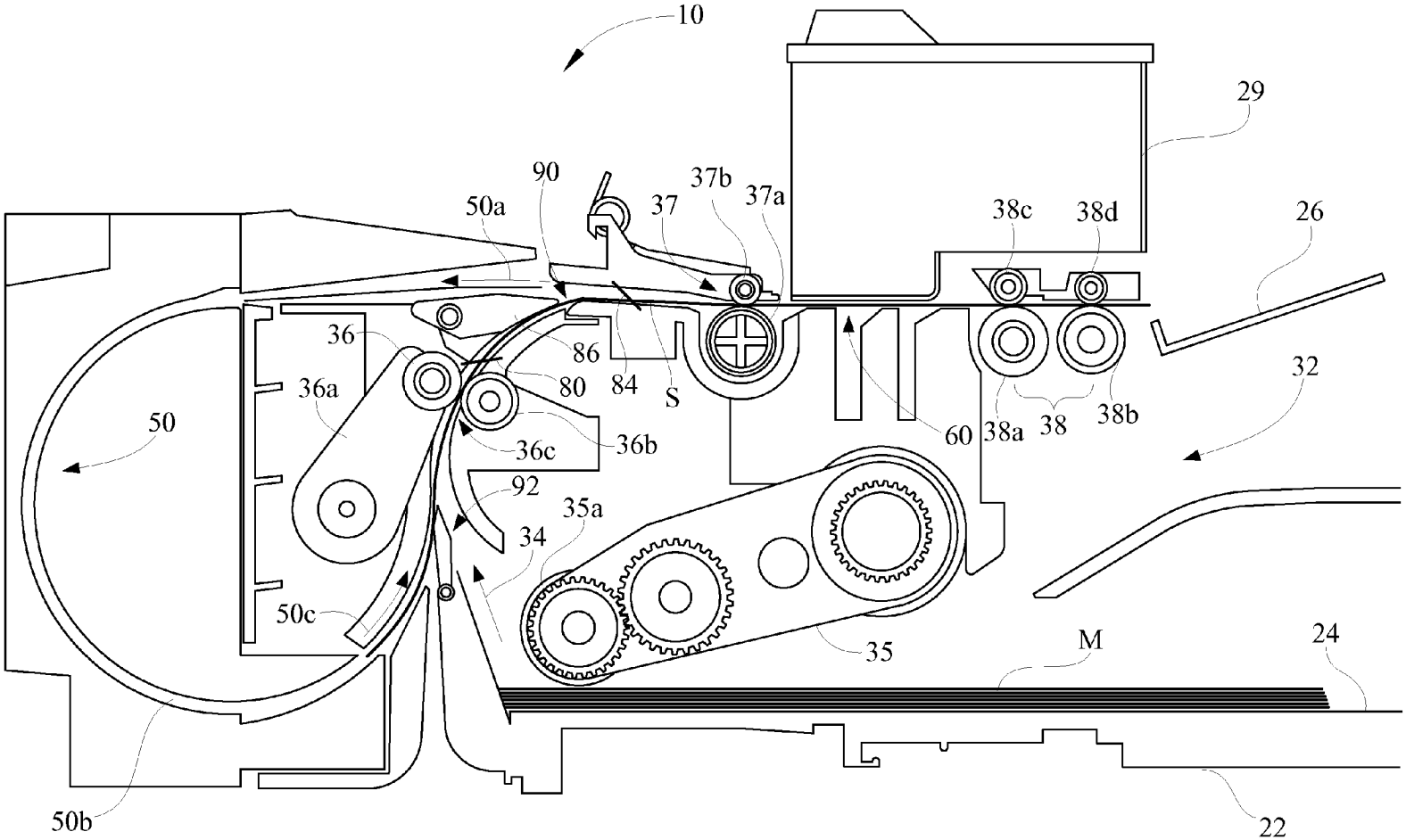

With reference to FIG. 6, the media sheet S is released from the feed nip 37 and driven by the roller 36 back towards the print zone 60. The media sheet S passes from the duplex path 50 to the simplex path 34 at the second intersection 92. With reference to FIG. 7, the media sheet S is driven by the roller 36 through the feed nip 37. The feed roller 37*a* then advances the media sheet S into the print zone 60. After printing, the media sheet S is ready to discharge to the output tray 26, thereby completing a duplex printing cycle. One skilled in the art will understand that as the media sheet S is advanced through the duplex path 50, the media changes orientation relative to the print cartridge 29. Specifically, as the media sheet S first passes the print cartridge 29 via the simplex path 34, the first (obverse) side of the media sheet S is exposed to the print cartridge 29. As the media sheet S reverses direction and passes through the duplex path 50, the media sheet S returns to the print cartridge 29 with the second (reverse) side of the media sheet S exposed to the print cartridge 29 for the duplex printing process.

FIGS. 5-7 demonstrate a duplex pick where the media sheet S is advanced through the duplex path 50 by the feed roller 37*a* or the exit drive system 38 until it reaches the simplex path 34 at which point the media sheet S is advanced to the feed nip 37 by the roller 36. In some embodiments, additional intermediate rollers are used including rollers on the duplex path 50 or rollers on the simplex path 34 either upstream or downstream from the roller 36.

Figure 8:
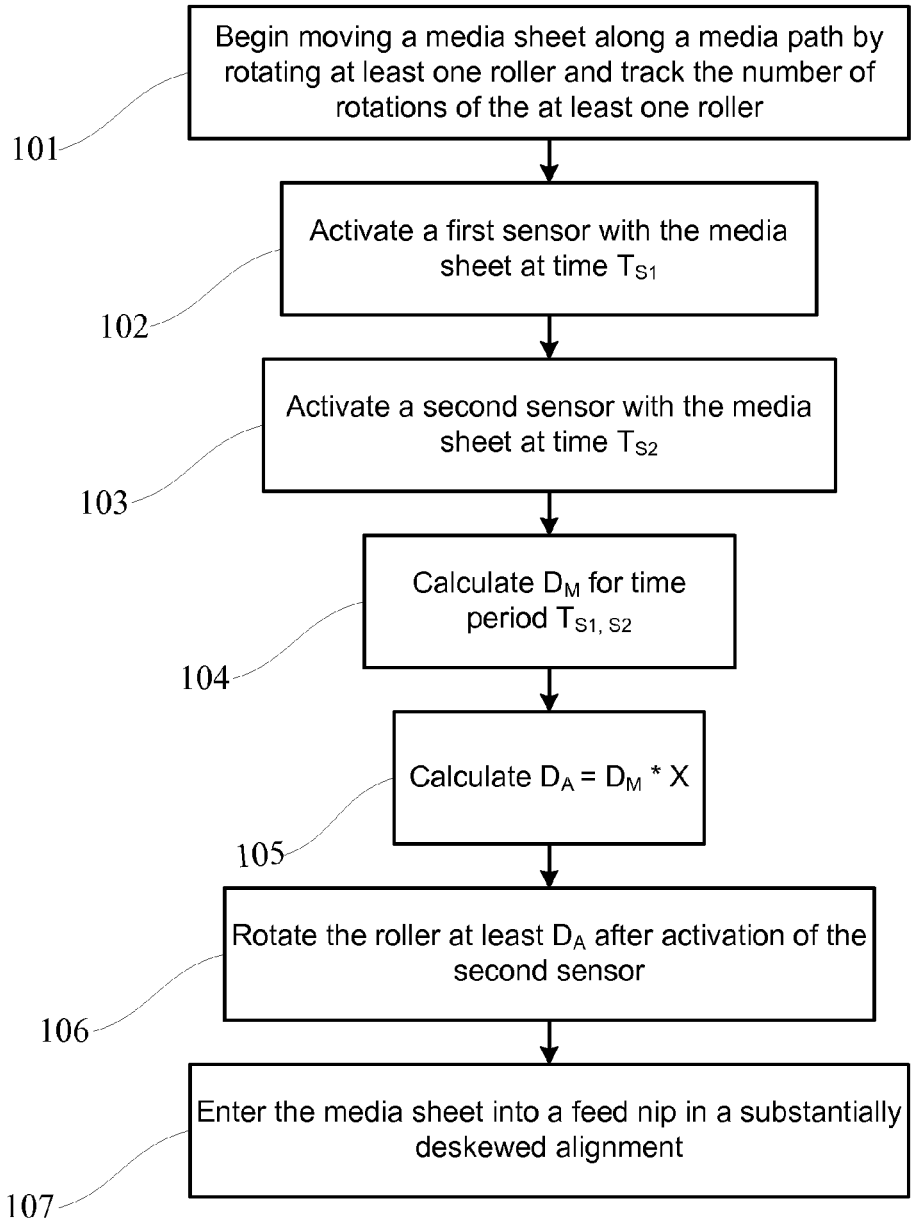
FIG. 8 is a flow chart of a method for moving a media sheet through an imaging device.

Referring to FIG. 8, a first method for moving a media sheet within an imaging device is provided. At 101, a media sheet S is moved along the media path 32 by at least one roller R such as, for example, the roller 36, the pick roller 35*a*, and/or an intermediate roller (not shown) which may be located between the roller 36 and the feed nip 37. As the at least one roller R rotates, feedback is received by the processor from an encoder wheel or other sensing means for tracking the number of rotations of the at least one roller R. At 102, the first sensor 80 is activated by the moving media sheet S at time $T_{S1}$. The location of the media sheet at time $T_{S1}$ is signaled to the processor. At 103, the second sensor 84 is activated by the moving media sheet S at time $T_{S2}$. The location of the media sheet at time $T_{S2}$ is signaled to the processor.

At 104, the processor calculates a distance $D_M$ where $D_M$ is a measured distance from the first sensor 80 to the second sensor 84 based on the feedback received indicating the number of rotations of the at least one roller R during a time period $T_{S1, S2}$ between activation of the first sensor 80 by the moving media sheet S at time $T_{S1}$ and activation of the second sensor 84 by the moving media sheet S at time $T_{S2}$. Each roller within the imaging device 10 includes a predetermined rotation distance $D_{REF}$ corresponding with a predetermined number of rotations of the roller such as, for example, a single rotation. For example, where $D_{REF}$ is based on a single rotation, the predetermined rotation distance $D_{REF}$ for a given roller is equal to the circumference of a portion of the roller in contact with the media sheet. The predetermined rotation distance $D_{REF}$ for each roller is stored in a memory within the imaging device 10. The processor calculates the distance $D_M$ between the location of the first sensor 80 and the location of the second sensor 84 by multiplying the number of rotations of the at least one roller R driving the media sheet S during the time period $T_{S1, S2}$ by the predetermined rotation distance $D_{REF}$ of the at least one roller R. Accordingly, the measured distance $D_M$ is a function of the rotational distance traveled by the at least one roller R during the time period $T_{S1, S2}$. Therefore, the measured distance $D_M$ does not necessarily equate with the physical distance between the first sensor 80 and the second sensor 84. Generally, the measured distance $D_M$ will be greater than the physical distance between the first sensor 80 and the second sensor 84 because the at least one roller R experiences slip in relation to the media sheet S and other motion loss. Accordingly, the measured distance $D_M$ accounts for this slip and motion loss. Where a plurality of rollers are used to move the media sheet S between the first sensor 80 and the second sensor 84, the rotation distance of each roller must be added together in order to determine the total measured distance $D_M$. For example if a first roller advances the media sheet S one-third of the way from the first sensor 80 to the second sensor 84 and a second roller advances the media sheet S the remaining distance to the second sensor 84, the rotational distance of the first roller and the second roller must be added together in order to determine the total measured distance $D_M$.

At 105, the processor calculates $D_A$ where $D_A$ is an adjusted distance from the second sensor 84 to the feed nip 37. The adjusted distance $D_A$ is equal to the measured distance $D_M$ from the first sensor 80 to the second sensor 84 multiplied by a constant X which is based on at least one predetermined distance in the media path 32. The constant X is stored in the memory within the imaging device 10. In some embodiments, the constant X is equal to C divided by B where B is a predetermined reference distance from the first sensor 80 to the second sensor 84 and C is a predetermined reference distance from the second sensor 84 to the feed nip 37. In some embodiments, the predetermined reference distances B and C are stored in the memory of the imaging device 10. In order to account for variances in slip and motion loss associated with different pick modes, the constant X and the predetermined reference distances B and C may correspond with a pick mode such that a direct pick will have constants $X_1$, $B_1$, $C_1$, an indirect pick will have constants $X_2$, $B_2$, $C_2$, and a duplex pick will have constants $X_3$, $B_3$, $C_3$. The reference distances B and C may correspond with the physical distances from the first sensor 80 to the second sensor 84 and from the second sensor 84 to the feed nip 37, respectively, such that if the distance from the first sensor 80 to the second sensor 84 is twice the distance from the second sensor 84 to the feed nip 37 then B will be twice C. However, this relationship may be altered in order to account for variation in the slip and/or motion loss experienced between the second sensor 84 and the feed nip 37 in comparison with the slip and/or motion loss experienced between the first sensor 80 and the second sensor 84. As a result of the calculation performed at 105, $D_A$ factors in the unexpected slip or motion loss experienced between the first sensor 80 and the second sensor 84 and anticipates that such slip or motion loss will also occur between the second sensor 84 and the feed nip 37. Further, the adjusted distance $D_A$ factors in media differences, variation between devices, and changes over the life of the device.

At 106, after activation of the second sensor 84, the at least one roller R is rotated at least a distance $D_A$. By rotating the at least one roller R at least the distance $D_A$, slip and motion loss are accounted for thereby ensuring that the media sheet S is advanced all the way to the feed nip 37. When the media sheet S arrives at the feed nip 37, the feed rollers 37*a* and 37*b* are stopped or rotating toward the entrance to the duplex path 50 thereby preventing the media sheet S from entering the feed nip 37. Rotating the at least one roller R at least the distance $D_A$ ensures that the media sheet S is advanced until the leading edge of the media sheet S is flush with the entrance to the feed nip 37 thereby ensuring that the media sheet S will enter the feed nip 37 in a substantially deskewed alignment. After the leading edge of the media sheet S is flush with the entrance to the feed nip 37, the feed rollers 37*a* and 37*b* begin to rotate in the direction of movement along the simplex path 34, advancing the media sheet S through the feed nip 37. Rotating the at least one roller R at least the distance $D_A$ also ensures that the amount of slip and motion loss is not overestimated. If the slip or motion loss is overestimated the at least one roller R will rotate for an excessive amount of time which may cause wear to the at least one roller R and, in some instances, unpleasant noise. Embodiments include those wherein after the at least one roller R is rotated at least a distance $D_A$, the at least one roller R is stopped. Rotation of the at least one roller R is no longer necessary to advance the media sheet S because once the media sheet S enters the feed nip 37, the feed roller 37*a* will advance the media sheet S. At 107, the media sheet S is entered into the feed nip 37 in a substantially deskewed alignment.

One skilled in the art will understand that the foregoing method is suitable for use in embodiments and alternatives other than those illustrated in the figures such as instances where it is desirable to advance a media sheet along a media path to a feed nip and to enter the media sheet into the feed nip in a substantially deskewed alignment. For example, the foregoing method may be applied to an ADF scanner 14 in order to ensure that a media sheet traveling through the automatic document feed enters feed rollers in a substantially deskewed alignment.

Depending on the length of the media sheet S, when moving on the duplex path 50, the trailing edge of the media sheet S may pass the second sensor 84 before the leading edge of the media sheet S arrives at the second sensor 84 along the simplex path 34. However, where the media sheet S is of a longer length, the trailing edge of the media sheet S may not pass the second sensor 84 before the leading edge of the media sheet S arrives at the second sensor 84 along the simplex path 34. Accordingly, a method for moving a media sheet within an imaging device utilizing one sensor is desirable.

Figure 9:
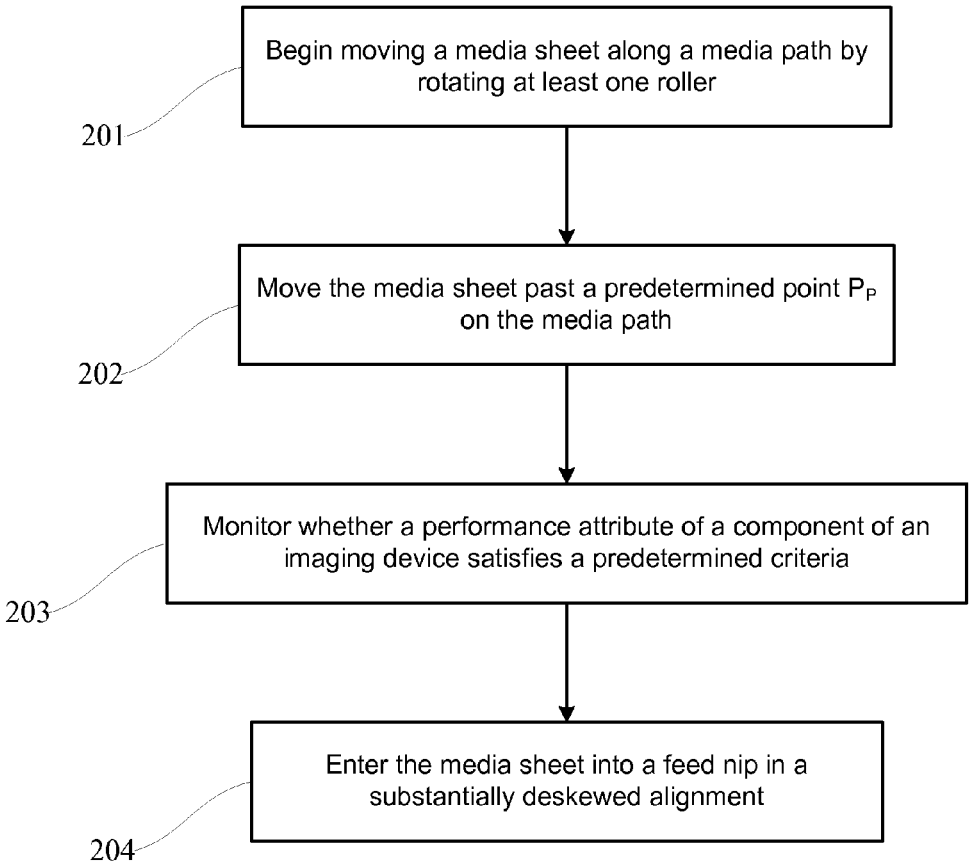
FIG. 9 is a flow chart of a method for moving a media sheet through an imaging device.

With reference to FIG. 9, a second method for moving a media sheet within an imaging device is provided. At 201, a media sheet S is moved along the media path 32 by a roller R such as, for example, the roller 36, the pick roller 35*a*, and/or an intermediate roller (not shown) which may be located between the roller 36 and the feed nip 37. In some embodiments, the roller R rotates at a substantially constant velocity when advancing the media sheet S.

At 202, the media sheet S is moved past a predetermined point $P_P$ along the media path. The point $P_P$ is disposed sufficiently downstream on the simplex path 34 from the roller R to reasonably ensure that the satisfaction of the predetermined criteria measured in step 203 is a result of the media sheet S arriving at the entrance to the feed nip 37 and not due to minor bumps or irregularities along the media path 32 or other factors. In those embodiments where the media path 32 includes both a simplex path 34 and a duplex path 50, the point $P_P$ is downstream, in terms of the direction of media sheet movement on the simplex path 34, from both intersection points 90 and 92 of the simplex path 34 and the duplex path 50. This ensures that the predetermined criteria measured in step 203 is a result of the media sheet S arriving at the entrance to the feed nip 37 and not to the leading edge of the media sheet S contacting a trailing portion of the media sheet S entering the duplex path 50. The point $P_P$ may be stored in a memory in the imaging device 10.

In some embodiments, the media sheet S activates a sensor, such as, for example, the first sensor 80 or the second sensor 84, adjacent to the media path 32. The predetermined point $P_P$ can then be determined using the sensor as a starting point for measuring the distance to point $P_P$. After the media sheet S activates the sensor, the roller R is rotated a predetermined distance $D_P$. The distance $D_P$ is stored in a memory in the imaging device 10. In some embodiments, the distance $D_P$ corresponds with a pick mode such that a direct pick will have a predetermined distance $D_{P1}$, an indirect pick will have a predetermined distance $D_{P2}$, and a duplex pick will have a predetermined distance $D_{P3}$. Similarly, the distance $D_P$ may correspond with a media type such as, for example, cardstock, photo paper, or multipurpose paper. The point $P_P$ is determined by the position of the leading edge of the media sheet on the media path after rotating the roller the distance $D_P$. Accordingly, the location of the point $P_P$ may differ for each media sheet depending on the slip and/or motion loss experienced. Further, the point $P_P$ may correspond with a pick mode or a media type. Rotating the roller R the distance $D_P$ ensures that the predetermined criteria measured in step 203 is a result of the media sheet S arriving at the entrance to the feed nip 37 and not to the leading edge of the media sheet S contacting a trailing portion of the media sheet S entering the duplex path 50.

At 203, the processor monitors whether a performance attribute of a component of the imaging device 10 satisfies a predetermined criteria. In some embodiments, the performance attribute of the component of the imaging device 10 comprises an input voltage of the motor driving the roller R. In these embodiments, in order to satisfy the predetermined criteria, the input voltage of the motor must exceed a predetermined voltage value for a predetermined amount of time. The predetermined voltage value is large enough to indicate that the media sheet S has encountered the resistance along the media path 32 associated with the media sheet's arrival at the entrance to the feed nip 37. However, the predetermined voltage value is lower than the voltage value typically associated with a motor stall. This ensures that the motor does not stall as a result of the media sheet's contact with the feed nip 37. The predetermined amount of time must be long enough to confirm that the increase in input voltage is due to the arrival of the media sheet S at the entrance to the feed nip 37 and not to minor bumps or irregularities along the media path 32. The predetermined amount of time is typically shorter than a time period that would be used to detect a motor stall. This is desirable to ensure that the motor does not stall. The predetermined amount of time in one exemplary embodiment is about 10 ms.

Alternatives include those wherein the performance attribute of the component of the imaging device 10 comprises the velocity of the roller R. In these alternatives, in order to satisfy the predetermined criteria, the velocity of the roller R must fall below a predetermined velocity value for a predetermined amount of time. The predetermined velocity value is low enough to indicate that the media sheet S has encountered the resistance along the media path 32 associated with the media sheet's S arrival at the entrance to the feed nip 37.

In some alternatives, these criteria are combined such that the performance attribute of the component of the imaging device 10 comprises the velocity of the roller R and the input voltage of the motor. In order to satisfy the predetermined criteria, the velocity of the roller R must fall below the predetermined velocity value for a first predetermined amount of time and the input voltage must exceed the predetermined voltage value for a second predetermined amount of time. The first predetermined amount of time may be equal to the second predetermined amount of time. Further, in some embodiments, the first predetermined amount of time is concurrent with the second predetermined amount of time.

Alternatively, the performance attribute of the component of the imaging device 10 may comprise a torque of the motor driving the roller R. In these alternatives, in order to satisfy the predetermined criteria, the torque of the motor must exceed a predetermined torque value for a predetermined amount of time. The predetermined torque value is large enough to indicate that the media sheet S has encountered the resistance along the media path 32 associated with the media sheet's S arrival at the entrance to the feed nip 37. However, the predetermined torque value is lower than the torque value typically associated with a motor stall. This ensures that the motor does not stall as a result of the media sheet's contact with the feed nip 37.

While the exemplary embodiments include predetermined criteria comprising an increase in input voltage to the motor, increase in torque of the motor, and decrease in roller velocity, any suitable performance attribute and associated criteria may be utilized which indicates that the media sheet S has arrived at the entrance to the feed nip 37. The satisfaction of the predetermined criteria for each page allows the imaging device 10 to automatically compensate for variables such as variation between devices and changes over the life of the device.

At 204, after the performance attribute of the component of the imaging device 10 satisfies the predetermined criteria, the media sheet S is entered into the feed nip 37 in a substantially deskewed alignment. Satisfaction of the predetermined criteria confirms that the media sheet S is advanced all the way to the entrance to the feed nip 37. When the media sheet S arrives at the feed nip 37, the feed rollers 37*a* and 37*b* are stopped or rotating toward the entrance to the duplex path 50 thereby preventing the media sheet S from entering the feed nip 37. The media sheet S is advanced until the leading edge of the media sheet S is flush with the entrance to the feed nip 37 thereby ensuring that the media sheet S will enter the feed nip 37 in a substantially deskewed alignment. The predetermined criteria is then satisfied. After satisfaction of the predetermined criteria, the feed rollers 37*a* and 37*b* begin to rotate in the direction of movement along the simplex path 34, advancing the media sheet S through the feed nip 37. Satisfaction of the predetermined criteria also ensures that the amount of slip and motion loss is not overestimated. If the slip or motion loss is overestimated the roller R will rotate for an excessive amount of time which may cause wear to the roller R and, in some instances, unpleasant noise. Embodiments include those wherein after the performance attribute of the component of the imaging device 10 satisfies the predetermined criteria, the speed of the roller R is altered. The roller R can be slowed, or in some instances stopped, because once the media sheet S passes through the feed nip 37 the feed roller 37*a*, as opposed to the roller R, will advance the media sheet S.

One skilled in the art will understand that the foregoing method is suitable for use in embodiments and alternatives other than those illustrated in the figures such as instances where it is desirable to advance a media sheet along a media path to a feed nip and to enter the media sheet into the feed nip in a substantially deskewed alignment. For example, the foregoing method may be applied to an ADF scanner 14 in order to ensure that a media sheet traveling through the automatic document feed enters feed rollers in a substantially deskewed alignment. Further, the first method, depicted in FIG. 8, may be used in isolation or in combination with the second method, depicted in FIG. 9. Similarly, the second method, depicted in FIG. 9, is suitable for use in isolation but may also be used in combination with the first method, depicted in FIG. 8.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method for moving a media sheet within an imaging device comprising:

moving a media sheet along a media path past a predetermined point $P_P$ on the media path by rotating a roller;

after the media sheet reaches the point $P_P$, begin monitoring whether a performance attribute of a component of the imaging device satisfies a predetermined criteria to signal that the media sheet is flush with an entrance to a feed nip;

after the performance attribute of the component of the imaging device satisfies the predetermined criteria, beginning to rotate the feed nip in a downstream direction to enter the media sheet into the feed nip in a substantially deskewed alignment; and while the media sheet is moving, activating a sensor adjacent to the media path with the media sheet, then rotating the roller a predetermined rotational distance $D_P$, wherein the point $P_P$ is determined by the position of the leading edge of the media sheet on the media path after rotating the roller the distance $D_P$, wherein the distance $D_P$ varies depending on a pick mode used.

2. The method of claim 1, wherein the performance attribute of the component of the imaging device comprises an input voltage of a motor driving the roller and in order to satisfy the predetermined criteria, the input voltage of the motor must exceed a predetermined voltage value for a predetermined amount of time.

3. The method of claim 1, wherein the performance attribute of the component of the imaging device comprises the velocity of the roller and in order to satisfy the predetermined criteria, the velocity of the roller must fall below a predetermined velocity value for a first predetermined amount of time.

4. The method of claim 3, wherein the performance attribute of the component of the imaging device further comprises an input voltage of a motor driving the roller and in order to satisfy the predetermined criteria, the input voltage of the motor must exceed a predetermined voltage value for a second predetermined amount of time.

5. The method of claim 4, wherein the first predetermined amount of time is concurrent with the second predetermined amount of time.

6. The method of claim 1, wherein the performance attribute of the component of the imaging device comprises a torque of a motor driving the roller and in order to satisfy the predetermined criteria, the torque of the motor must exceed a predetermined torque value for a predetermined amount of time.

7. The method of claim 1, wherein the imaging device comprises a simplex path and a duplex path, the simplex path and the duplex path intersect twice on the media path, and the point $P_P$ is downstream, in terms of the direction of media sheet movement on the simplex path, from both intersection points of the simplex path and the duplex path.

8. The method of claim 1, further comprising after the performance attribute of the component of the imaging device satisfies the predetermined criteria, altering the speed of the roller.

9. The method of claim 8, wherein after the performance attribute of the component of the imaging device satisfies the predetermined criteria, the roller is stopped.

10. A method for moving a media sheet within an imaging device comprising:

moving a media sheet along a media path by rotating a roller driven by a motor;

while the media sheet is moving, activating a sensor with the media sheet;

after activating the sensor with the media sheet, rotating the roller at least a predetermined rotational distance $D_P$, after rotating the roller at least the distance $D_P$, begin monitoring whether an input voltage of the motor exceeds a predetermined voltage value for a first predetermined amount of time and whether the velocity of the roller falls below a predetermined velocity value for a second predetermined amount of time to signal that the media sheet is flush with an entrance to a feed nip; and after the input voltage of the motor exceeds the predetermined voltage value for the first predetermined amount of time and the velocity of the roller falls below the predetermined velocity value for the second predetermined amount of time, beginning to rotate the feed nip in a downstream direction to enter the media sheet into the feed nip in a substantially deskewed alignment, wherein the distance $D_P$ varies depending on a pick mode used.

11. The method of claim 10, wherein the first predetermined amount of time is concurrent with the second predetermined amount of time.

12. The method of claim 10, wherein the imaging device includes a simplex path and a duplex path and the simplex path and the duplex path intersect twice on the media path, further comprising after rotating the roller at least the distance $D_P$, the leading edge of the media sheet being downstream, in terms of the direction of media sheet movement on the simplex path, from both intersection points of the simplex path and the duplex path.

13. The method of claim 10, further comprising after the input voltage of the motor exceeds the predetermined voltage value for the first predetermined amount of time and the velocity of the roller falls below the predetermined velocity value for the second predetermined amount of time, altering the speed of the roller.

14. The method of claim 13, wherein after the input voltage of the motor exceeds the predetermined voltage value for the first predetermined amount of time and the velocity of the roller falls below the predetermined velocity value for the second predetermined amount of time, the roller is stopped.

15. A method for moving a media sheet within an imaging device comprising:

moving a media sheet along a media path by rotating a roller driven by a motor;

while the media sheet is moving, activating a sensor with the media sheet;

after activating a sensor with the media sheet, rotating the roller at least a predetermined rotational distance $D_P$, after rotating the roller at least the distance $D_P$, begin monitoring whether a torque of the motor exceeds a predetermined torque value for a predetermined amount of time to signal that the media sheet is flush with an entrance to a feed nip; and after the torque of the motor exceeds the predetermined torque value for the predetermined amount of time, beginning to rotate the feed nip in a downstream direction to enter the media sheet into the feed nip in a substantially deskewed alignment, wherein the distance $D_P$ varies depending on a pick mode used.

16. The method of claim 15, wherein the imaging device includes a simplex path and a duplex path and the simplex path and the duplex path intersect twice on the media path, further comprising after rotating the roller at least the distance $D_P$, the leading edge of the media sheet being downstream, in terms of the direction of media sheet movement on the simplex path, from both intersection points of the simplex path and the duplex path.

17. The method of claim 15, further comprising after the torque of the motor exceeds the predetermined torque value for the predetermined amount of time, altering the speed of the roller.

18. The method of claim 17, wherein after the torque of the motor exceeds the predetermined torque value for the predetermined amount of time, the roller is stopped.

* * * * *